US011371819B1

(12) United States Patent
Runell et al.

(10) Patent No.: US 11,371,819 B1
(45) Date of Patent: Jun. 28, 2022

(54) PACKAGING FOR STORAGE AND TRANSPORTATION OF 30 MM×173 MM AMMUNITION

(71) Applicants: Jason B. Runell, East Stroudsburg, PA (US); Ricardo Villela, Staten Island, NY (US); Niral Patel, Parsippany, NJ (US); Alan Cohen, Wharton, NJ (US); Christopher Griffith, East Stroudsburg, PA (US)

(72) Inventors: Jason B. Runell, East Stroudsburg, PA (US); Ricardo Villela, Staten Island, NY (US); Niral Patel, Parsippany, NJ (US); Alan Cohen, Wharton, NJ (US); Christopher Griffith, East Stroudsburg, PA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 2798 days.

(21) Appl. No.: 13/718,271

(22) Filed: Dec. 18, 2012

(51) Int. Cl.

| | |
|---|---|
| ***F42B 39/26*** | (2006.01) |
| ***F42B 39/08*** | (2006.01) |
| ***B65D 25/10*** | (2006.01) |
| ***B65D 85/30*** | (2006.01) |
| ***B65D 25/04*** | (2006.01) |

(52) U.S. Cl.
CPC ..... *F42B 39/08* (2013.01); *B65D 25/04* (2013.01); *B65D 25/108* (2013.01); *B65D 85/30* (2013.01); *F42B 39/26* (2013.01)

(58) Field of Classification Search
CPC ..... F42B 39/26; F42B 39/00; F42B 39/14; F42B 39/24; F42B 39/28; B65D 25/04; B65D 25/108; B65D 85/30
USPC ..... 206/3
See application file for complete search history.

(56) References Cited

U.S. PATENT DOCUMENTS 4,942,991 A * 7/1990 Lyons ..... F42B 39/02 206/3
8,028,826 B1 * 10/2011 Woo ..... F42B 39/26 206/3

* cited by examiner

*Primary Examiner* — Jonathan C Weber
(74) *Attorney, Agent, or Firm* — John P. DiScala

(57) ABSTRACT

A packaging arrangement for 30 mm×173 mm ammunition rounds. The packaging arrangement has a heavy duty standoff device of defined height, which standoff device mounts a very high strength support plate and a heavy duty restraining plate. The support plate has through holes (of diameter slightly less than the rounds defined maximum diameter) to hold the rounds of in an upside down position and from sliding/moving. The height of the standoff device keeps the rounds from being able to touch the bottom of the metal box. The restraining plate has multiple recessed areas sized to accommodate the back ends of the said rounds. The packaging arrangement is lowered into a metal box with handles for carriage purposes. On top, there are Homosite filler pads, and the box accommodates a top lid.

15 Claims, 6 Drawing Sheets

PACKAGING FOR STORAGE AND TRANSPORTATION OF 30 MM×173 MM AMMUNITION

U.S. GOVERNMENT INTEREST

The inventions described herein may be made, used, or licensed by or for the U.S. Government for U.S. Government purposes.

BACKGROUND OF INVENTION

The US Army requires an improved packaging configuration for currently qualified 30 mm×173 mm ammunition, to be handled in quantities of 30 linked rounds. The improved packaging configuration will have to meet the U.S. Army's rough handling requirements as prescribed by MIL-STD-1904. Further, an improved packaging configuration will have to solve at least two current problems where as a result of handling and transportation the rounds frequently have exhibited bent links and flattened projectile tips. Such damage results in expensive loss of ammunition, both as to cost and as to readiness in the field. Also, the ammunition container is heavy and should not exhibit wobbling when carried in the field by soldiers, or in other transportation. These problems have heretofore not been adequately addressed, and a solution is certainly badly required.

BRIEF SUMMARY OF INVENTION

The packaging arrangement of this invention utilizes a heavy duty stand-off device which can mount a support plate and a restraining plate. The support plate has at least thirty through holes (of diameter slightly less than the round's maximum diameter) into which rounds of ammunition can be inserted one per hole in an upside down position until they are snugly held from sliding down any further. The height of the standoff device is chosen to insure that the tips of these rounds can never touch the ground. At the other end of the rounds there is a restraining plate, which has a like pattern and quantity of round recessed areas sized to accommodate the backs of the rounds. The backs of the rounds (essentially flat and of circular cross sectional shape) just fit right into the recessed areas. Thus, the restraining plate holds the rounds in place from their back ends, and the other ends of the rounds are held snugly in the support plate in corresponding holes of the same pattern, by gravity. Therefore, when the packaging arrangement is upright the rounds are successfully held upside down by the standoff device, support plate, and restraining plate, and with the ammunition tips well off the ground. This latter described assembly is then placed in a metal box which has side handles for carriage purposes. On top, there is a homosite filler pad and a metal lid over all. As will be described, the height of the standoff device will be adjusted to lower the center of gravity of the ammunition to below that of the carrying handles. This prevents wobbling.

OBJECTS OF THE INVENTION

Accordingly, it is an object of the present invention to provide a packaging device for 30 mm×173 mm linked ammunition that can support at least thirty rounds for safe storage and carriage without breakage or denting, even under rough handling conditions.

It is a still further object of the present invention to provide a packaging device and storage container for 30 mm×173 mm linked ammunition, which device is compatible to insensitive munition requirements, even under rough handling conditions.

Another object of the present invention is to provide a packaging device and storage container, for 30 mm×173 mm linked ammunition, which storage container can be carried fully loaded without wobbling or excessive fatigue to soldiers.

It is yet another object of the present invention to provide a less expensive packaging device and storage container for 30 mm×173 mm linked ammunition, wherein the components of the packaging device are also made largely of recyclable/reusable materials.

These and other objects, features and advantages of the invention will become more apparent in view of the within detailed descriptions of the invention, the claims, and in light of the following drawings wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention. The invention for example could be used to support other types of ammunition or other types of munitions/items and not just on the 30 mm×173 mm ammunition shown.

LIST OF DRAWINGS

Figure 4A:
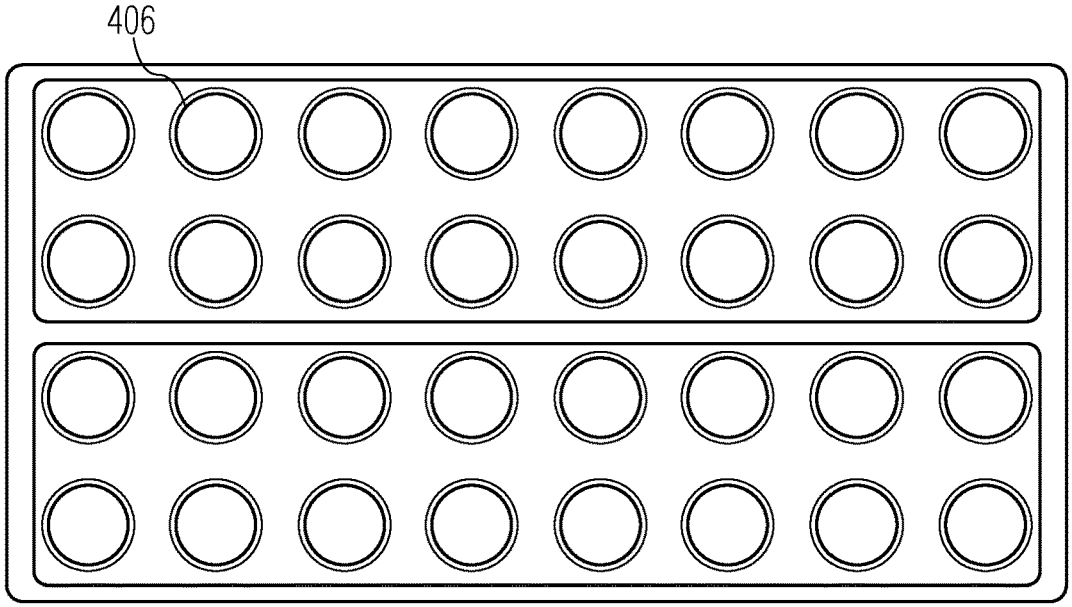
FIG. 4A shows a top view of support plate top piece 401 having through holes 406 sized for the rounds' diameter, according to this invention.
Figure 4B:
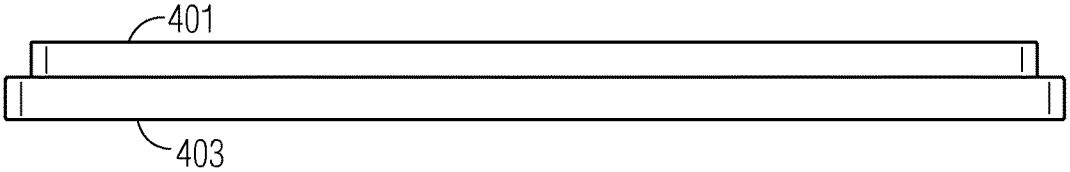
FIG. 4B shows a side view of the support plate which has a top section 401 and a bottom section 403, according to this invention.
Figure 4C:
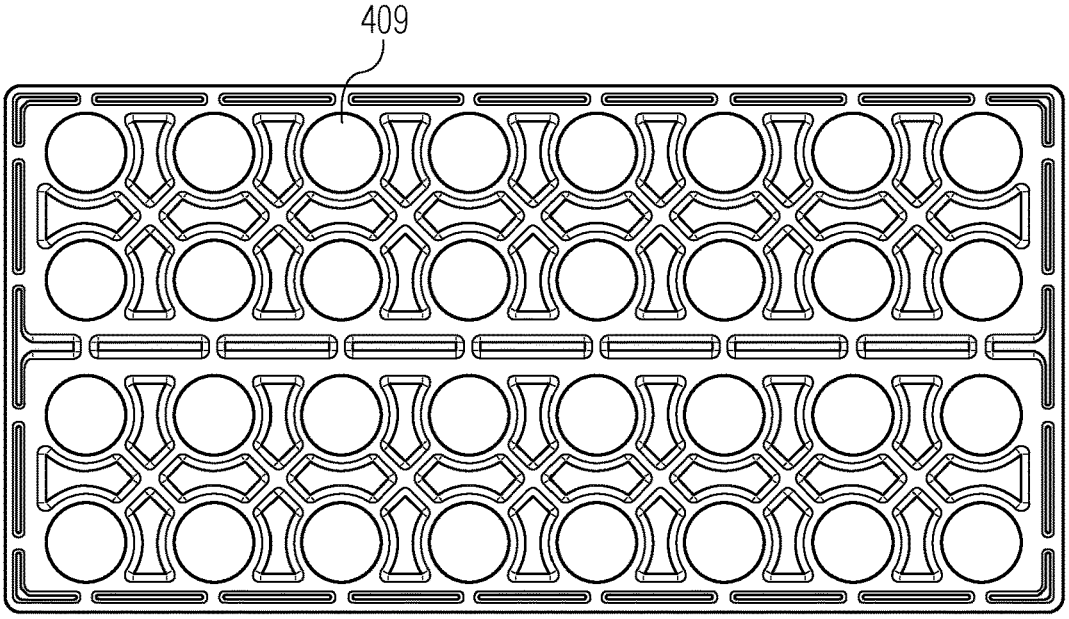

FIG. 4C shows a bottom view of support plate bottom piece 403 also having through holes 409 (same as holes 406 in FIG. 4A) for holding the rounds, according to this invention.

Figure 5A:
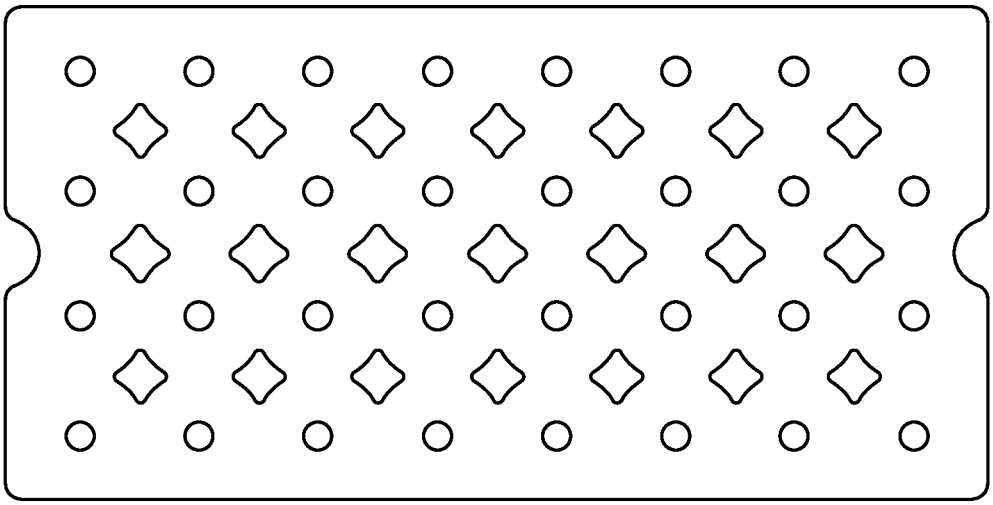

FIG. 5A shows a top view of the restraining plate 103, according to this invention.

Figure 5B:
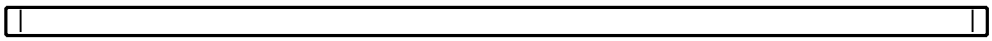

FIG. 5B shows a side view of the restraining plate 103, according to this invention.

Figure 5C:
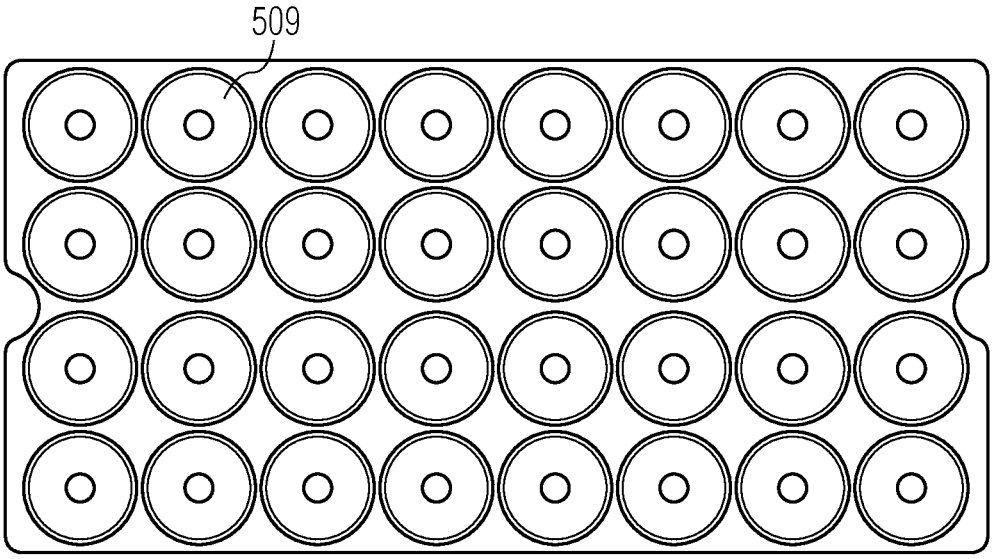

FIG. 5C shows a bottom view of the restraining plate 103, having plural recessed areas 509 sized for holding the rounds, according to this invention.

Figure 6:
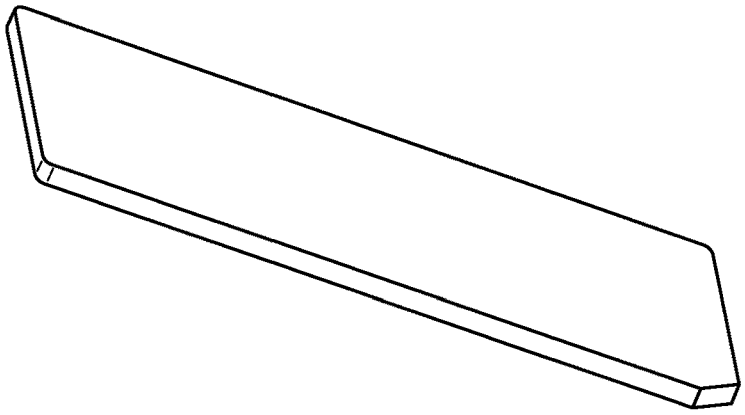

FIG. 6 shows top filler pad 101, according to this invention.

Figure 7:
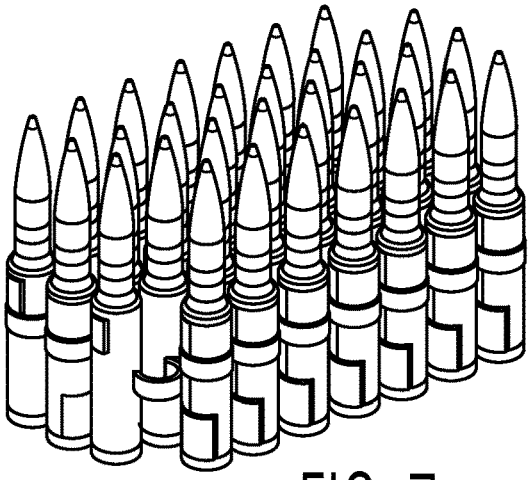

FIG. 7 shows the links on the ammunition, according to this invention.

Figure 8:
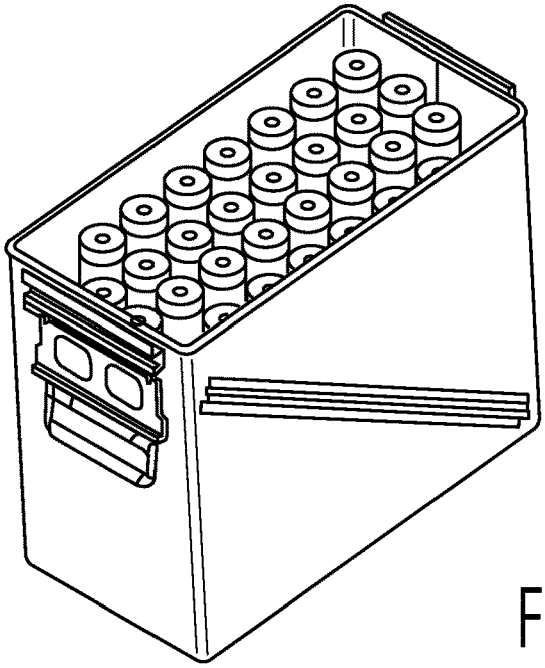

FIG. 8 shows the ammunition assembly sitting in its enclosure box without the restraining plate, according to this invention.

DETAILED DESCRIPTION

Figure 1:
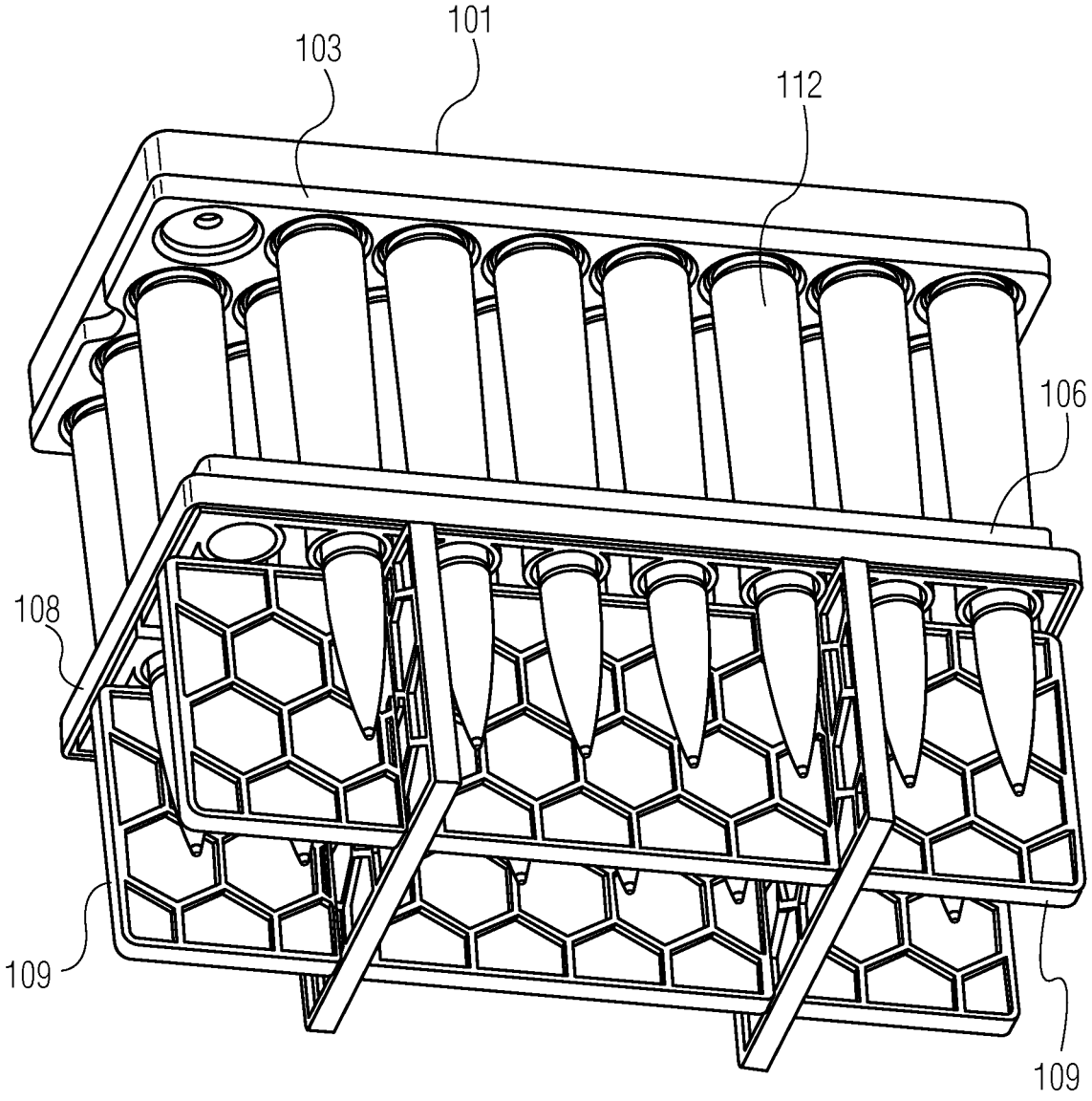
FIG. 1 shows a bottom view isometric of a round assembly, according to this invention.
Figure 2:
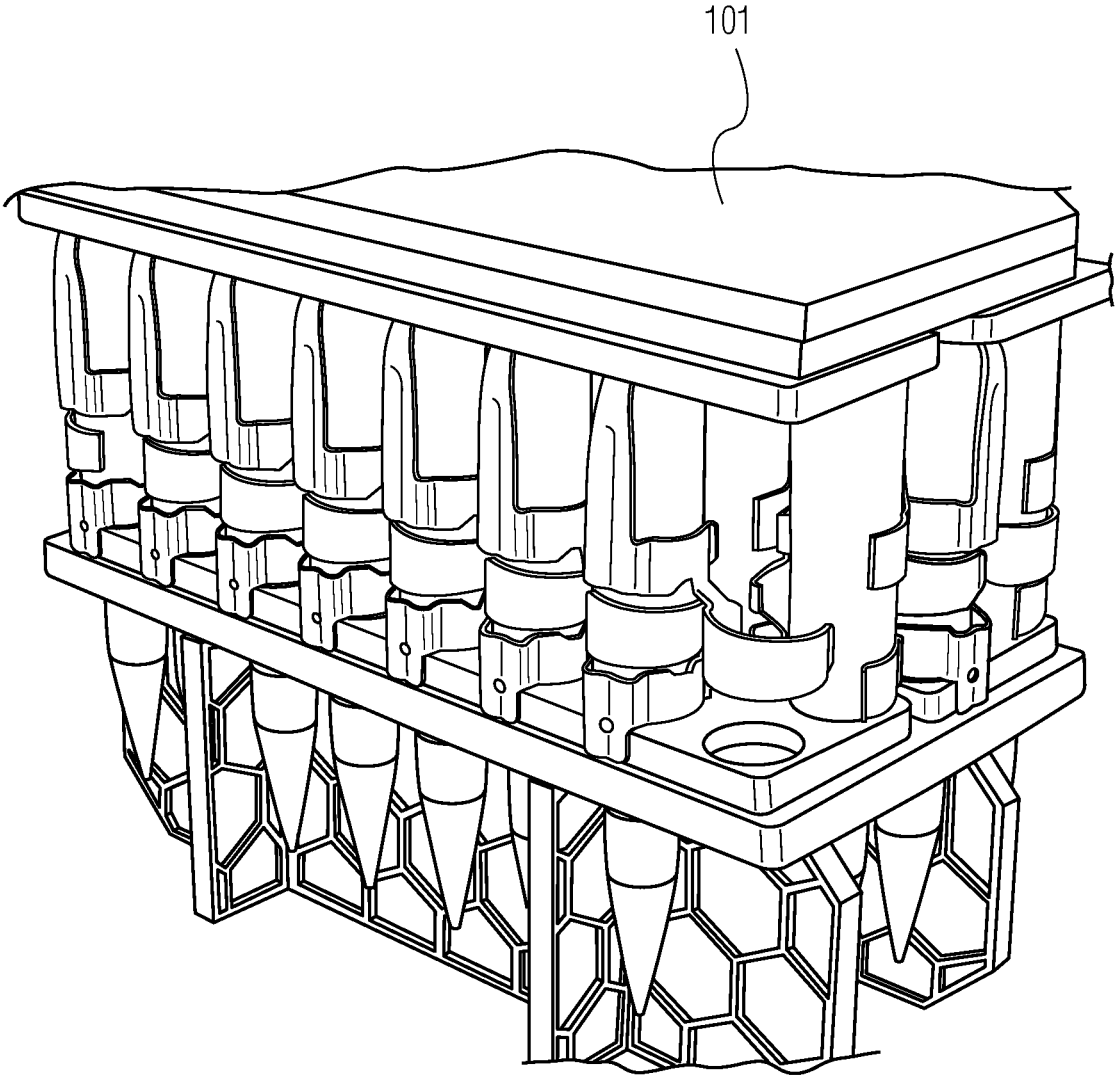
FIG. 2 shows a top view isometric of another round assembly, according to this invention.
Figure 3A:
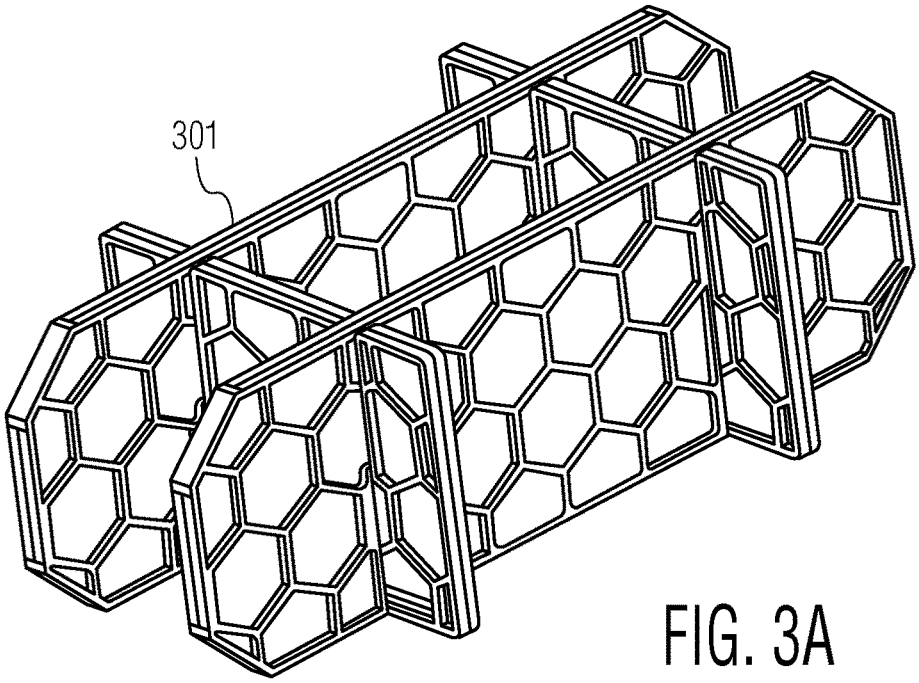
FIG. 3A is a top isometric view of an assembled stand-off device 301 comprising the pieces (2 pieces each) in FIG. 3B and in FIG. 3C, according to this invention.
Figure 3B:
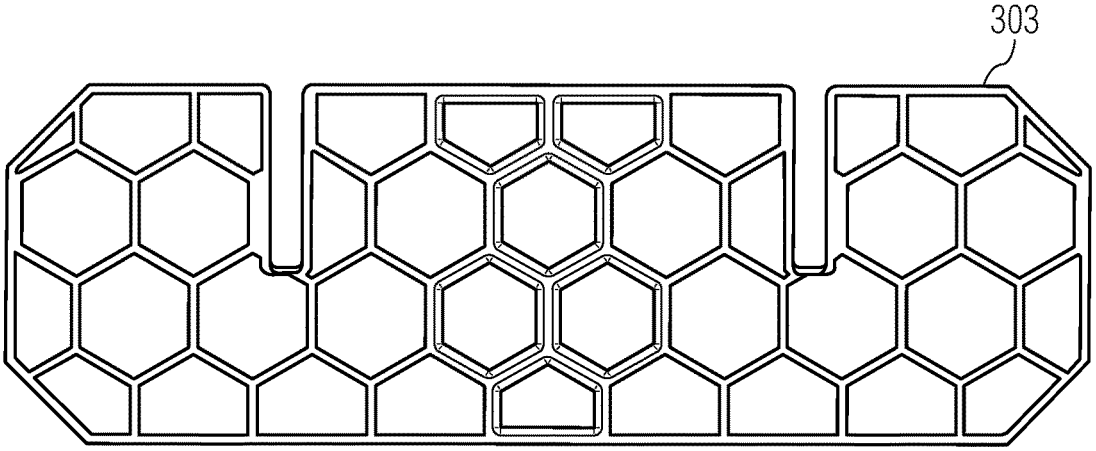
Figure 3C:
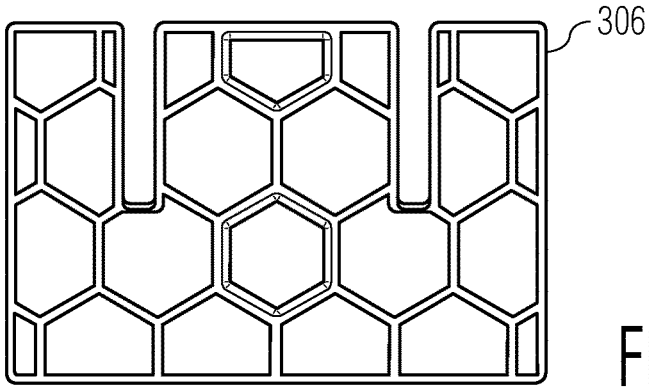

FIG. 1 shows a bottom view isometric of the round assembly, where 112 is a round of ammunition; 101 is a top filler pad (FIG. 6); 103 is a restraining plate; 106 is the top section of a support plate; 108 is bottom section of a restraint plate and 109 is a stand-off assembly. FIG. 2 shows a top view isometric of a slightly improved assembly of this device. The ammunition here are shown with links thereon, and the improved stand-off assembly here has trimmed corners on the parts 303, 306, per FIGS. 3A, 3B, and 3C. FIG. 3A is a top view of an isometric view of the assembled stand-off device 301. It is assembled with two of piece 303 with two of piece 306. The support plate has at least thirty through holes (of diameter slightly less than the round's maximum diameter) into which rounds of ammunition can be inserted one per hole in an upside down position until they are snugly held from sliding down any further. The height of the standoff device is chosen to insure that the tips of these rounds can never touch the ground. At the other end of the rounds there is a restraining plate, which has a like pattern and quantity of round recessed areas sized to accommodate the backs of the rounds. The backs of the rounds (essentially flat and of circular cross sectional shape) just fit right into the recessed areas. Thus, the restraining plate holds the rounds in place from their back ends, and the other ends of the rounds are held snugly in the support plate in corresponding holes of the same pattern, by gravity. Therefore, when the packaging arrangement is upright, the rounds are successfully held upside down by the standoff device, support plate, and restraining plate, and with the ammunition tips well off the bottom of the metal box. This latter described assembly is then placed in a metal box which has side handles for carriage purposes. On top, there is a homosite filler pad and a metal box lid over all. As will be described, the height of the standoff device will be adjusted to lower the center of gravity of the ammunition to below that of the carrying handles. This prevents wobbling. FIG. 4B shows a side view of the support plate which has a top section 401 and a bottom section 403. FIG. 4A shows a top view of support plate top section 401 having through holes 406 sized for the rounds' diameter; FIG. 4C shows a bottom view of support plate bottom section 403 having equally sized through holes 409 (same as holes 406) for holding the rounds. FIG. 5B shows a side view of a restraining plate. FIG. 5A shows a top view of the restraining plate 103; FIG. 5C shows a bottom view of the restraining plate having plural recessed areas 509 sized for holding the rounds. FIG. 6 shows top filler pad 101 (two are used in assembly). FIG. 7 shows the links on the ammunition. FIG. 8 shows the ammunition assembly sitting in its enclosure box without the restraining plate 103, two filler pads 101, or any lid to this box shown. The device was designed to comply with U. S. Army rough handling scenario requirements prescribed by MIL-STD-1904, including possible temperature extremes (−65 F to +160 F). The improved packaging configuration of this device is more compatible with insensitive munition (IM) compliant ammunition systems than other IM current devices such as those using blast mitigation barrier concepts and venting techniques. This device's IM qualities act to protect personnel and materiel from possible blast devastation. This device protects the fragility of the ammunition and device components from maximum expected G's of force. Attention is paid to weight and center of gravity of the device's assembly so that it can be carried more comfortably by soldiers in the field. Standoff device 301 was originally fabricated with sheet metal, later improved as HDPE (high density polyethylene) material. HDPE was chosen for standoff 301 and restraining plate 103 because it is sufficiently robust at temperature extremes, and is one of the lowest cost commodity plastic resins. There are extensive varieties of injection molding resins on the market. Glass reinforced, less hygroscopic, Nylon 66 was used for the support plate because of additional strength and dimensional stability offered by an engineering resin for this component. Nylon 6 has a relatively high hygroscopic nature therefore the slightly more expensive, less hygroscopic, Nylon 66 was used in this device. A loaded carrying container (which was originally wobbly during a two-man carry) was changed to lower its center of gravity below the level of its carrying handles. Thus, the packaged ammunition could then be carried with much more ease, preventing potential user fatigue and possible injury. To do so, standoff 301 was shortened to lower the ammunition center of gravity closer to the bottom of the container. This done, there was left a void at the top of the container which was filled with lightweight homosote filler pads in lieu of designing a thicker restraining plate to fill such void. Homosote was used for these top filler pads because of its qualities of cushioning ability, high compressive strength, low recurring cost, non-existent tooling cost, and low weight. Glass reinforced nylon 66 is used for support plate sections 401 and 403 because injection molding can lower overall part costs. Further, injection molding machines have automated statistical process controls to ensure all parameters are kept within a certain threshold. This helps insure uniform part quality and avoid unnecessarily high scrap, rework costs, and rejections at a load plant, for example. Coring was used to eliminate unnecessary material to reduce weight and cost while maintaining structural integrity. The coring feature on the stand-off 301 is a honey-comb pattern, and on the support plate 401 and 403 the coring feature is the complex geometry shown in FIG. 4C. Additionally, minor damage was noted on the bottom corners of the standoff during corner down drop testing from seven feet height at −65 F. As a result, the tooling was modified to include a generous chamfer visible at the corners of the standoff to prevent impact and stress concentrations at those locations. The support plate had cracked along the perimeter during side-down drop testing from seven feet at −65 F therefore strengthening features are provided along the perimeter of the support plate. Each component is potentially recyclable. After following proper decontamination procedures, the HDPE components can be recycled similarly as to standard bottle and can recycling procedures and the nylon support plate might be sold for use as a reground resin. The homosote filler pads are a paper product which might be recycled similarly to standard paper recycling procedures. The new dunnage components take up considerably less volume when shipped from the manufacturer to a load plant and this allows for more efficient interplant shipment. This was achieved by making an interlocking standoff assembly 301 made of two each of parts 303 and 306. Each component of the standoff is shipped unassembled and flat to the load plant where it will be assembled on the line. The improved injection molded dunnage system of this device costs approximately $16-$18 per set compared to previously used foam dunnage costing approximately $28 per set/container designed by the U.S. Navy. This contributes to significant annual material cost savings overall and additional cost savings could even be achieved by reusing the dunnage for training ammunition configurations.

While the invention may have been described with reference to certain embodiments, numerous changes, alterations and modifications to the described embodiments are possible without departing from the spirit and scope of the invention as defined in the appended claims, and equivalents thereof.

What is claimed is:

1. A packaging arrangement for 30 mm×173 mm ammunition rounds, each round having a defined maximum round diameter, a tip, an equal defined round height between the defined maximum round diameter and the tip, and defined flat, circular cross section back end, said packaging arrangement comprising:

a standoff device of defined standoff height, which standoff device mounts a support plate and a restraining plate;

said support plate having through holes of diameter less than the defined maximum round diameter into which holes the rounds are stacked facing downward, said standoff height greater than the defined round height;

said restraining plate having a pattern of recessed areas each sized to receive a defined round back end;

said rounds thereby supported by the standoff device in said support plate and restraining plate, with the ammunition above a bottom of a metal container box.

2. The packaging arrangement of claim 1 wherein said support plate is comprised of two sections.

3. The packaging arrangement of claim 1 wherein said standoff device comprises four sections which are fit together for assembly of the standoff device.

4. The packaging arrangement of claim 1 wherein the restraining device has coring to reduce weight.

5. The packaging arrangement of claim 1 wherein the standoff device is structured in a honeycomb pattern to reduce weight.

6. The packaging arrangement of claim 1 wherein the standoff device has a border around a perimeter of the standoff device.

7. The packaging arrangement of claim 1 wherein the standoff device has trimmed chamfered corners.

8. The packaging arrangement of claim 1 wherein the support plate device has coring to reduce weight.

9. The packaging arrangement of claim 1 wherein the standoff device is made of high density polyethylene (HDPE) material.

10. The packaging arrangement of claim 1 wherein the support plate is made of Glass filled Nylon 66 material.

11. The packaging arrangement of claim 1 wherein the packaging arrangement can carry a quantity of up to thirty rounds.

12. The packaging arrangement of claim 1 wherein the metal container box has side carrying handles.

13. The packaging arrangement of claim 12 wherein the standoff height is selected so that the center of gravity of the ammunition loaded packaging arrangement is lower than the level of the side carrying handles.

14. The packaging arrangement of claim 1 wherein two Homosite filler pads are placed in the metal container box, above the packaging arrangement.

15. The packaging arrangement of claim 1 wherein the metal container box can accommodate a top lid.

* * * * *